US011108133B2

(12) United States Patent
Wu et al.

(10) Patent No.: US 11,108,133 B2
(45) Date of Patent: Aug. 31, 2021

(54) ANTENNA SYSTEM AND MOBILE TERMINAL IMPLEMENTED WITH THE ANTENNA SYSTEM

(71) Applicant: AAC Technologies Pte. Ltd., Singapore (SG)

(72) Inventors: Jing Wu, Shenzhen (CN); Ke Hua, Shenzhen (CN); Haibing Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 127 days.

(21) Appl. No.: 16/699,702

(22) Filed: Dec. 1, 2019

(65) Prior Publication Data

US 2020/0203806 A1 Jun. 25, 2020

(30) Foreign Application Priority Data

Dec. 24, 2018 (CN) ..... 201811581133.7

(51) Int. Cl.
*H01Q 23/00* (2006.01)
*H01Q 1/24* (2006.01)

(52) U.S. Cl.
CPC ..... *H01Q 1/243* (2013.01); *H01Q 23/00* (2013.01)

(58) Field of Classification Search
CPC ..... H01Q 5/328; H01Q 1/243; H01Q 23/00; H01Q 9/0421; H01Q 5/378
See application file for complete search history.

(56) References Cited

U.S. PATENT DOCUMENTS

2003/0210206 A1* 11/2003 Phillips ..... H01Q 1/50 343/895
2009/0224991 A1* 9/2009 Rowson ..... H01Q 9/0421 343/747
2012/0009884 A1* 1/2012 Rao ..... H01Q 21/30 455/73
2012/0146865 A1* 6/2012 Hayashi ..... H01Q 9/42 343/750
2014/0218247 A1* 8/2014 Tefiku ..... H01Q 1/243 343/752
2014/0266922 A1* 9/2014 Jin ..... H01Q 5/314 343/702
2014/0292590 A1* 10/2014 Yoo ..... H01Q 1/243 343/702

(Continued)

*Primary Examiner* — Dimary S Lopez Cruz
*Assistant Examiner* — Bamidele A Jegede
(74) *Attorney, Agent, or Firm* — W&G Law Group LLP

(57) ABSTRACT

An antenna system and a mobile terminal implemented with the antenna system are provided. The mobile terminal has a metal frame and a system grounding. The antenna system has at least a first antenna module, a second antenna module, a third antenna module and a fourth antenna module. The first antenna module has a radiating body and a parasitic element coupled to the radiating body. The radiating body is configured to generate a main harmonic, and the parasitic element is configured to generate a parasitic harmonic. The first antenna module further has a first tuning circuit and a second tuning circuit. The antenna system has at least four operation modes. The antenna system of the present invention may achieve carrier aggregation of different LTE frequencies, and may be used as a MIMO antenna system.

16 Claims, 8 Drawing Sheets

(56) References Cited

U.S. PATENT DOCUMENTS

| | | | | |
|---|---|---|---|---|
| 2014/0333496 | A1* | 11/2014 | Hu | H01Q 9/0421 343/745 |
| 2016/0036127 | A1* | 2/2016 | Desclos | H01Q 5/364 343/745 |
| 2016/0294038 | A1* | 10/2016 | Lo | H01Q 1/48 |
| 2016/0308563 | A1* | 10/2016 | Ouyang | H01Q 25/005 |
| 2016/0322702 | A1* | 11/2016 | Sayama | H01Q 3/28 |
| 2017/0005413 | A1* | 1/2017 | Tai | H01Q 1/243 |
| 2017/0062932 | A1* | 3/2017 | Foster | H01Q 1/243 |
| 2017/0125901 | A1* | 5/2017 | Sharawi | H01Q 1/243 |
| 2017/0155187 | A1* | 6/2017 | Lin | H01Q 1/273 |
| 2017/0244151 | A1* | 8/2017 | Han | H01Q 5/30 |
| 2017/0244153 | A1* | 8/2017 | Chen | H01Q 1/48 |
| 2017/0331188 | A1* | 11/2017 | Yin | H01Q 21/30 |
| 2017/0358847 | A1* | 12/2017 | Cho | H05K 1/18 |
| 2018/0183137 | A1* | 6/2018 | Tsai | H01Q 5/335 |
| 2018/0277929 | A1* | 9/2018 | Seo | H01Q 5/20 |
| 2018/0294547 | A1* | 10/2018 | Park | H04B 7/0802 |
| 2018/0309193 | A1* | 10/2018 | Wen | H01Q 5/371 |
| 2018/0331415 | A1* | 11/2018 | Wu | H01Q 1/243 |
| 2018/0342792 | A1* | 11/2018 | Hashizume | H01Q 9/42 |
| 2018/0342794 | A1* | 11/2018 | Han | H01Q 5/328 |
| 2018/0342800 | A1* | 11/2018 | Nishizaka | H01Q 1/525 |
| 2018/0351235 | A1* | 12/2018 | Wang | H01Q 5/378 |
| 2018/0351255 | A1* | 12/2018 | Singh | H01Q 5/378 |
| 2018/0358699 | A1* | 12/2018 | Li | H01Q 11/14 |

* cited by examiner

ANTENNA SYSTEM AND MOBILE TERMINAL IMPLEMENTED WITH THE ANTENNA SYSTEM

FIELD OF THE PRESENT INVENTION

The present invention relates to the field of communication technology, and more particularly to an antenna system and a mobile terminal implemented with the antenna system.

DESCRIPTION OF RELATED ART

As the development of communication technology, cell phones, PADs and laptops have gradually become essential electronic products in our life. These electronic products are all implemented with an antenna module such that they can have communication function.

Design of size and appearance of a mobile terminal is one important focus nowadays. In order to meet users' requirement, current mobile terminals are usually designed to have a bezel-less screen, a glass back cover and a metal frame. A communication device with a bezel-less screen may only provide very small clearance space or even no clearance space, which may deteriorate the performance and bandwidth of a single antenna and brings large difficulty to design of low frequency coverage and carrier aggregation (CA). Furthermore, as the fifth-generation communication is coming, mobile communication terminals would support a transmitting system with more Multiple-Input Multiple-Output (MIMO) antennas for cell phones in order to raise transmission speed and increase transmission capacity, which means the antenna arrangement of cell phones would be upgraded from 2*2 or 4*4 to 8*8. This gives further difficulties to antenna design.

Therefore, a new antenna module is required to solve the above problems.

BRIEF DESCRIPTION OF THE DRAWINGS

In order to clearly explain the technical solutions in the embodiments of the present invention, the drawings used in the description of the embodiments will be briefly described below. Obviously, the drawings in the following description are merely some embodiments of the present invention. For those of ordinary skill in the art, other drawings may also be obtained based on these drawings without any creative work.

DETAILED DESCRIPTION OF THE EXEMPLARY EMBODIMENT

The disclosure will now be described in detail with reference to the accompanying drawings and examples. Apparently, the described embodiments are only a part of the embodiments of the present invention, not all of the embodiments. All other embodiments obtained by a person of ordinary skill in the art based on the embodiments of the present invention without creative efforts shall fall within the protection scope of the present invention.

Figure 1:
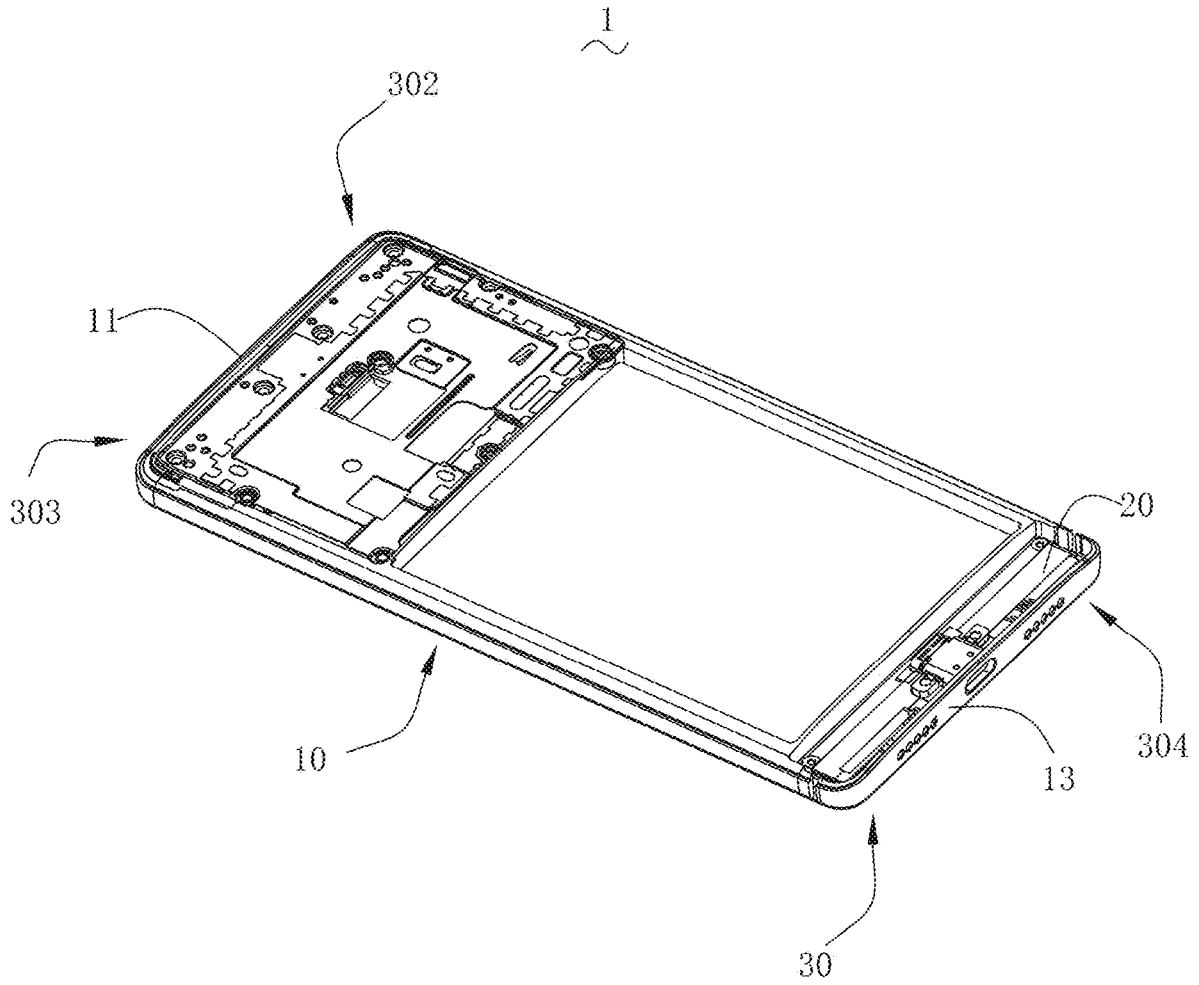
FIG. 1 shows an isometric view of a portion of a mobile terminal according to the present invention.
Figure 2:
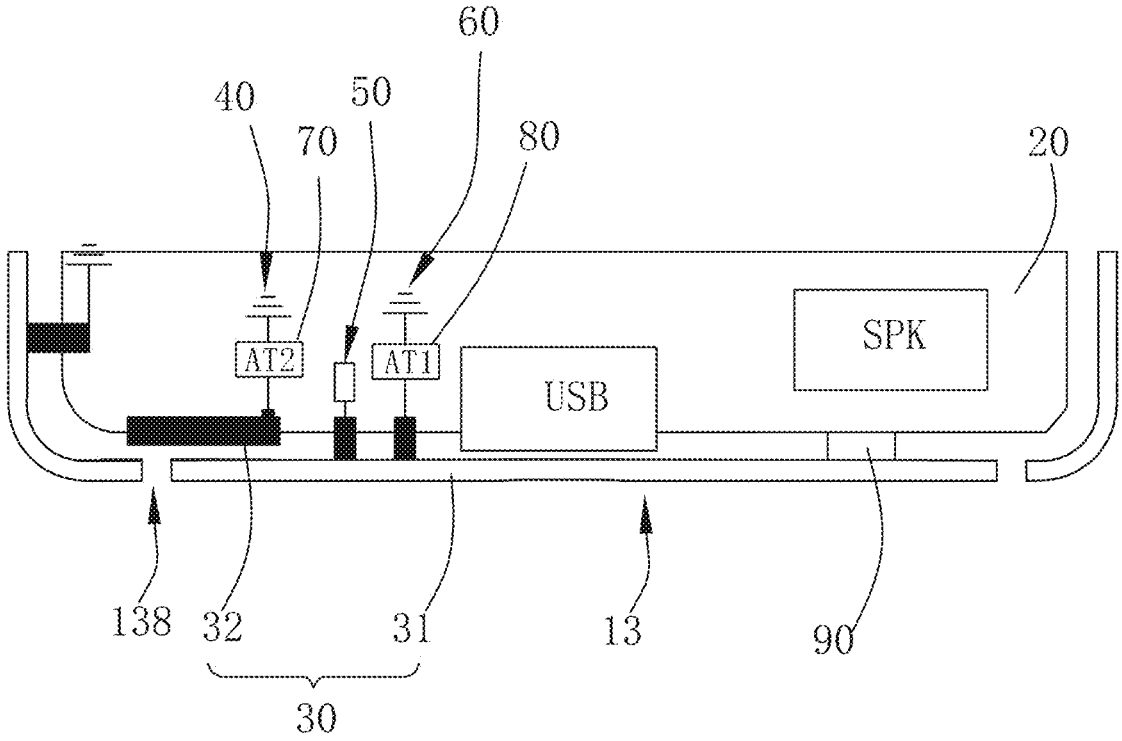
FIG. 2 shows a schematic diagram of a first antenna module implemented in a mobile terminal according to the present invention.

As shown in FIGS. 1 and 2, the present invention provides a mobile terminal 1. The mobile terminal 1 may be a cell phone, tablet computer, multi-media player etc. In order to be advantageous for understanding, a cell phone will be taken as an example in following embodiments.

The mobile terminal 1 includes a metal frame 10, a system grounding 20 spaced from the metal frame 10, and an antenna system.

The metal frame 10 includes a top frame 11 located at the top thereof and a bottom frame 13 located at the bottom thereof. The bottom frame 13 may define a gap 138 and may be arranged with a metal connector 90 connected to the system grounding 20.

The antenna system may include at least four antenna modules including a first antenna module 30, a second antenna module 302, a third antenna module 303 and a fourth antenna module 304. The first antenna module 30 and the fourth antenna module 304 are respectively arranged at two ends of the bottom frame 13. The second antenna module 302 and the third antenna module 303 are respectively arranged at two ends of the top frame 11. The first antenna module 30 and the second antenna module 302 may be arranged along a diagonal of the mobile terminal.

The first antenna module 30 includes a radiating body 31 formed in the metal frame 10 and a parasitic element 32 coupled to the radiating body 31. Specifically, the radiating body 31 is a portion of the metal frame 10 located between the metal connector 90 and the gap 138. The parasitic element 32 may be a metal layer electrically having an elongated shape which is connected to the system grounding 20.

The first antenna module 30 may further include a feed line 50 connected to the radiating body 31, a parasitic line 40 connecting the parasitic element 32 and the system grounding 20, and a grounding line 60 connecting the radiating body 31 and the system grounding 20. The parasitic line 40 and the grounding line 60 may be respectively located at two sides of the feed line 50.

The first antenna module 30 only takes very small space of the mobile terminal. A distance between the metal connector 90 and an end of the radiating body 31 away from the metal connector 90 may be no larger than ⅔ of a length of the bottom frame 13. The distance here refers to a distance along the extending direction of the bottom frame.

Furthermore, the system grounding 20 and the bottom frame 13 are spaced apart to form a small clearance zone. Specifically, a width of the clearance zone may be less than 2 mm. The width here refers to a size along the direction pointing from the system grounding 20 to the bottom frame 13.

In the first antenna module 30, the radiating body 31 is configured to generate a main harmonic, and the parasitic element 32 is configured to generate a parasitic harmonic. In order to tune the main harmonic, the feed line 60 may be implemented with a first tuning circuit 80. In order to tune the parasitic harmonic, the parasitic line 40 may be implemented with a second tuning circuit 70.

The antenna system may include at least four operation modes described below.

In a first operation mode, the first tuning circuit of the first antenna module may switch among multiple operation states such that the main harmonic covers an LTE low frequency and switches among multiple wave bands of the LTE low frequency. The second tuning circuit is configured to keep one operation state such that the parasitic harmonic covers LTE medium and high frequencies. The second tuning circuit includes at least one small-capacitance capacitor. The capacitance of the small-capacitance capacitor may be less than 0.8 pF. The first antenna module and the second antenna module cooperatively consist a 2*2MIMO system covering the LTE low, medium and high frequencies in this mode.

In a second operation mode, the first tuning circuit of the first antenna module may switch among multiple operation states such that the main harmonic may cover the LTE low frequency and switch among multiple wave bands of the LTE low frequency. The second tuning circuit may switch among multiple operation states such that the parasitic harmonic may cover the LTE medium frequency and switch among multiple wave bands of the LTE medium frequency. The first antenna module, the second antenna module, the third antenna module and the fourth antenna module cooperatively consist a 4*4MIMO system covering the LTE medium frequency in this mode.

In a third operation mode, the first tuning circuit of the first antenna module may switch among multiple operation states such that the main harmonic may cover the LTE low frequency and switch among multiple wave bands of the LTE low frequency. The second tuning circuit may switch among multiple operation states such that the parasitic harmonic may cover the LTE high frequency and switch among multiple wave bands of the LTE high frequency. The first antenna module, the second antenna module, the third antenna module and the fourth antenna module cooperatively consist a 4*4MIMO system covering the LTE high frequency in this mode.

In a fourth operation mode, the first tuning circuit is configured to keep one operation state such that the main harmonic may cover the LTE medium and high frequencies. The second tuning circuit is configured to keep one operation state such that the parasitic harmonic may cover the LTE medium and high frequencies. The first antenna module, the second antenna module, the third antenna module and the fourth antenna module cooperatively consist a 4*4MIMO system covering the LTE medium and high frequencies.

In some embodiments, in any of the first, second and third operations modes, the first tuning circuit 80 may be grounded through an inductor. That is, by switching the inductance, the main harmonic may operate in different low frequency wave bands.

In the fourth operation mode, the first tuning circuit 80 may be grounded through an inductor or a capacitor, or be short-circuited to ground. In other word, in this operation mode, the specific structure of the first tuning circuit 80 is not limited as long as the main harmonic may be tuned to the medium and high frequencies.

In the first operation mode, the second tuning circuit 70 may include at least one small-capacitance capacitor. The small-capacitance capacitor may have a capacitance less than 0.8 pF. In any of the second, third and fourth operation modes, the second tuning circuit 70 may be grounded through a capacitor or a combination of an inductor and a capacitor.

Figure 3:
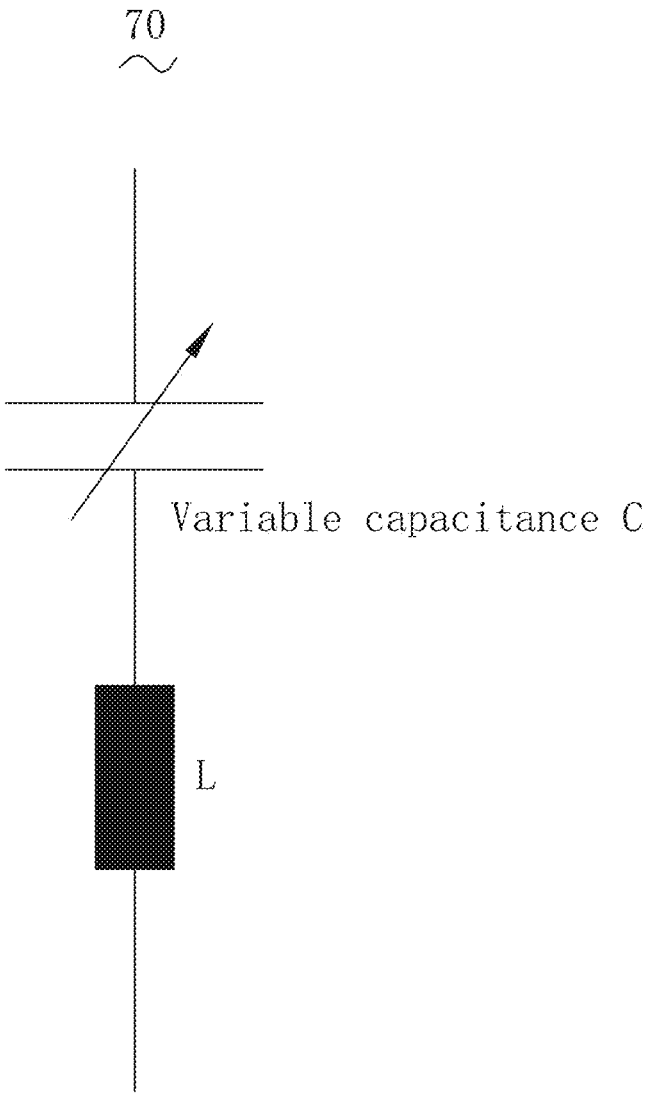
FIG. 3 is a topological structure diagram of a second tuning circuit according to the present invention.
Figure 4:
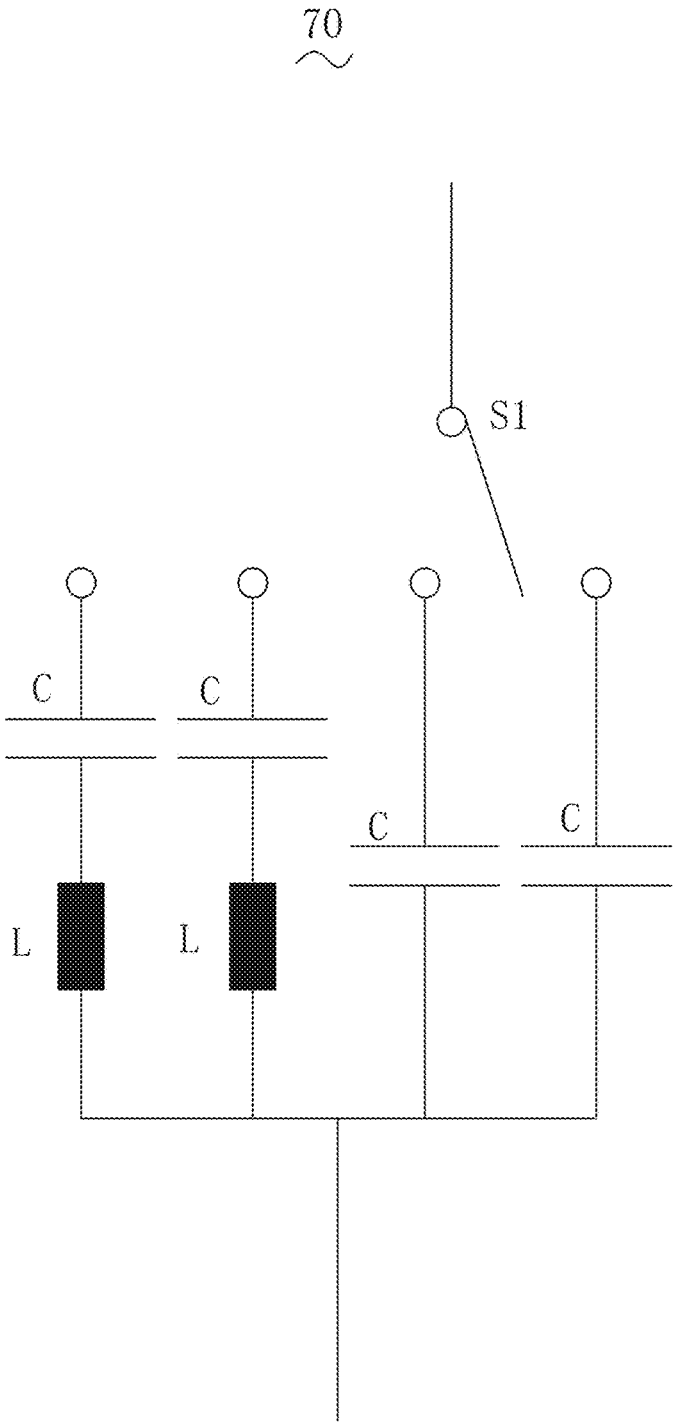
FIG. 4 is another topological structure diagram of a second tuning circuit according to the present invention.
Figure 5:
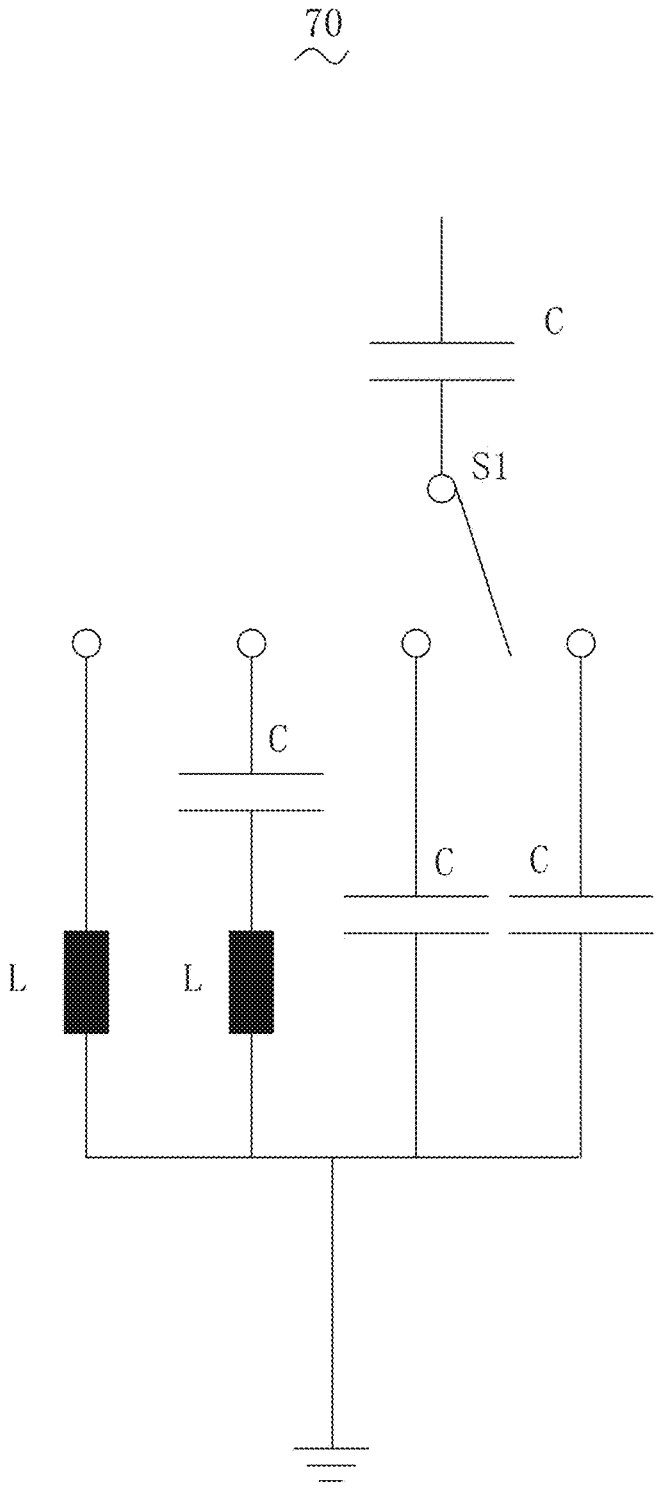
FIG. 5 is yet another topological structure diagram of a second tuning circuit according to the present invention.

Specifically, FIGS. 3-5 show different embodiments of the structure of the second tuning circuit 70. In the embodiment of FIG. 3, the second tuning circuit 70 may include a variable capacitor C and an inductor L connected in series. In the embodiment of FIG. 4, the second tuning circuit 70 may have four branches that may be selectively switched on in different operation states. A capacitor C is connected in series in each of the branches, and an inductor L is connected in series in some of the branches. In the embodiment of FIG. 5, the second tuning circuit also has four branches that may be selectively switched on in different operation states, which is similar to the embodiment of FIG. 4. However, in this embodiment, a capacitor C in connected in series to the primary line, and the branches may be implemented either with or without a capacitor. It should be noticed that, FIGS. 3-5 are merely three exemplary embodiments of the second tuning circuit 70, and the topological structure of the second tuning structure 70 is not limited thereto as long as the portion of the second tuning circuit 70 that is switched on may include a capacitor connected in series in each operation state. Specifically, in the first operation mode, the second tuning circuit 70 may be implemented with a capacitor with small capacitance in order to reduce influence of the parasitic element 32 on low frequencies. The reason is that, in general, the capacitance coupling effect between the parasitic element 32 and the system grounding 20 may deviate the frequency of the low frequency harmonic to a lower value to a certain extent, which requires the diameter of low frequency radiating body to be reduced and leads to a degradation of the low frequency performance. Thus, in the present invention, in order to reduce influence of the parasitic element 32 on low frequency and improve low frequency performance, a capacitor is connected in series in the second tuning circuit 70 which may reduce interference of the parasitic element 32 on low frequencies and enhance low frequency performance of the antenna. In other words, the capacitor is connected in series to the coupling capacitance between the parasitic element 32 and the radiating body 31 so as to reduce interference on low frequencies.

It should be understood, the specific structures of the second antenna module 302, the third antenna module 303 and the fourth antenna module 304 are not limited in the present invention as long as the second antenna module 302 may cover the LTE low, medium and high frequencies, and the third antenna module 303 and the fourth antenna module 304 may each cover the LTE medium and high frequencies. In some embodiments, the second antenna module 302 may have a similar structure and operation modes as the first antenna module 30, while the third antenna module 303 and the fourth antenna module 304 may not be implemented with a tuning circuit so as to simplify the operation mode of the antenna system.

The gap 138 is not necessarily formed in the bottom frame 13 according to the present invention. For example, the gap may alternatively be formed in a side frame adjacent to the bottom frame 13 based on actual requirement.

Figure 6:
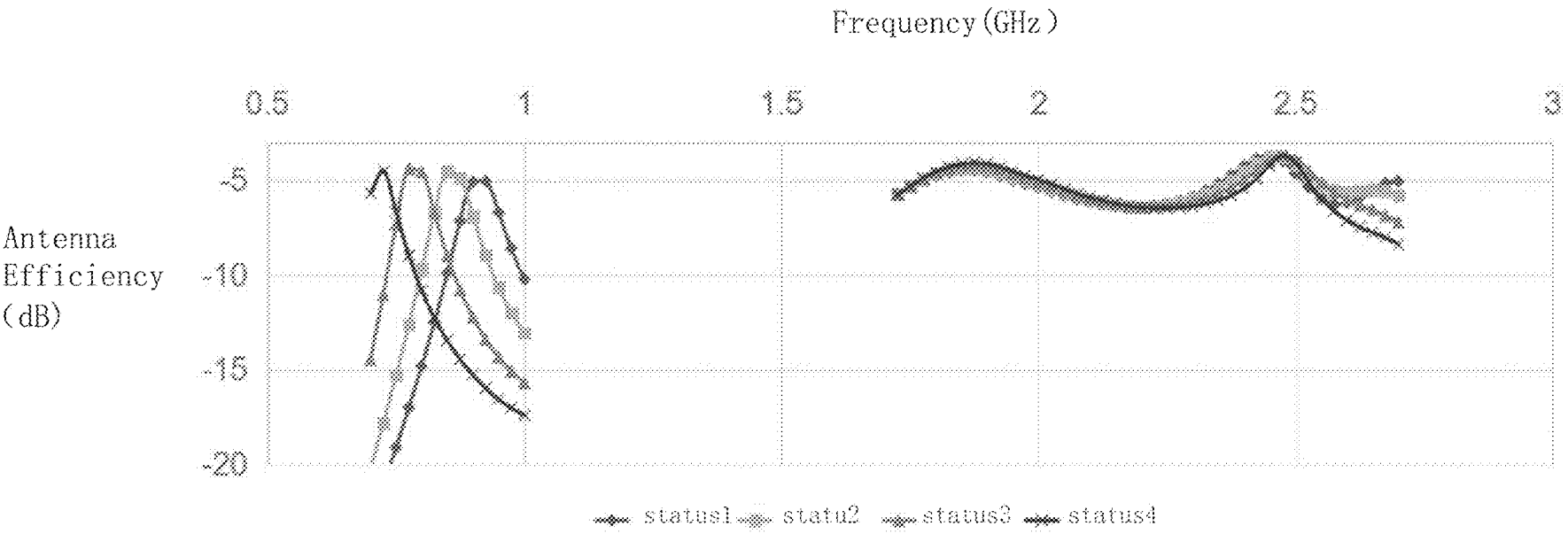
FIG. 6 illustrates a simulation result of the radiation efficiency of the first antenna module of the present invention operating in a first operation mode.
Figure 7:
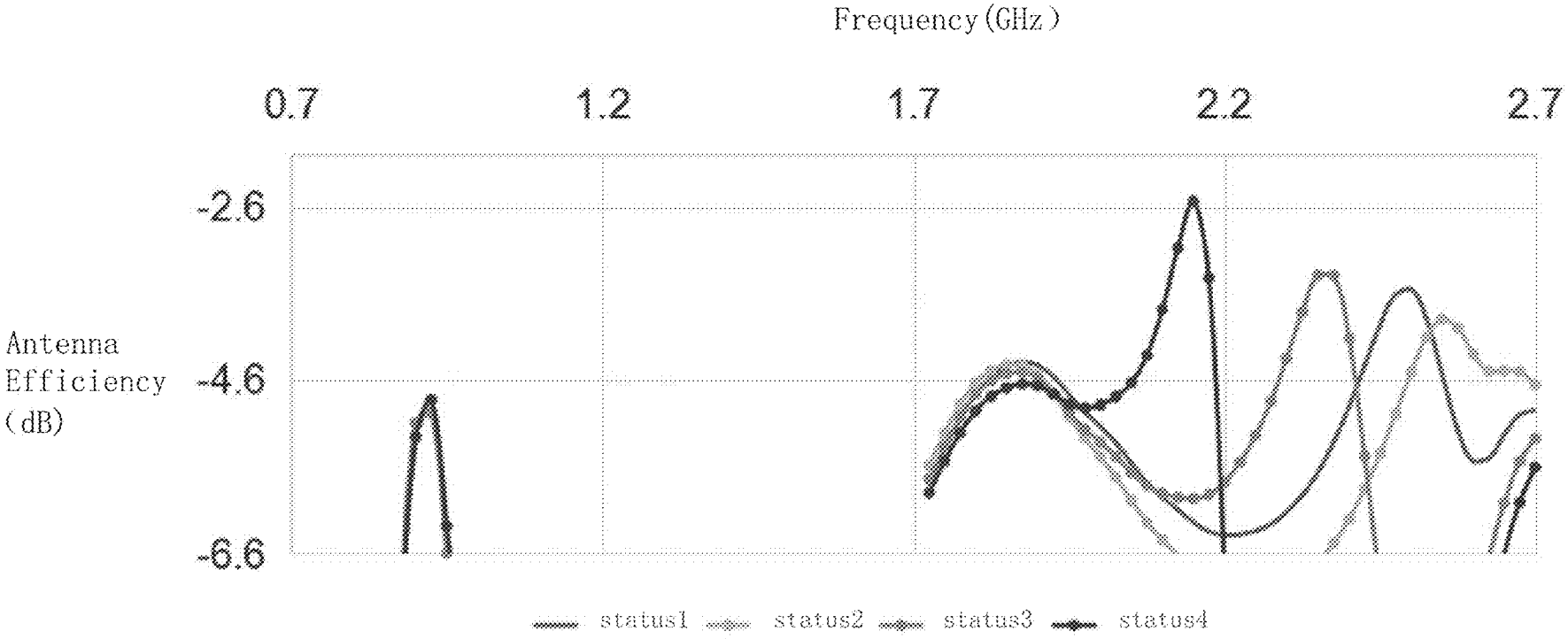
FIG. 7 illustrates a simulation result of the radiation efficiencies of the first antenna module operating in a second operation mode and a third operation mode, and of the first tuning circuit operating in a certain operation state.

The performance of the first antenna module 30 is shown in FIGS. 6 and 7. As shown in FIG. 6, when the first antenna module is in the first operation mode, the first tuning circuit 80 may operate in four different operation states (State 1, State 2, State 3 and State 4). Correspondingly, the main harmonic may generate four different low frequency harmonics, and the parasitic harmonic may generate the medium and high harmonics. It can be seen from the curve that the performance of medium and high frequencies is substantially unchanged when the low frequency harmonic switches. As shown in FIG. 7, when the first antenna module is in the second operation mode and the third operation mode and the first antenna module 80 is in a certain operation mode, the second tuning circuit 70 may operate in four different operation states (State 1, State 2, State 3 and State 4). Correspondingly, the main harmonic may generate the low frequency harmonics and the parasitic harmonic may generate the low and/or high frequency harmonics. Compared with the first operation mode, the performance of medium and high frequency harmonic may be enhanced. It can be seen from the curve shown in FIG. 7 that the low frequency performance is substantially unchanged when the medium and high frequency harmonics switch.

Figure 8:
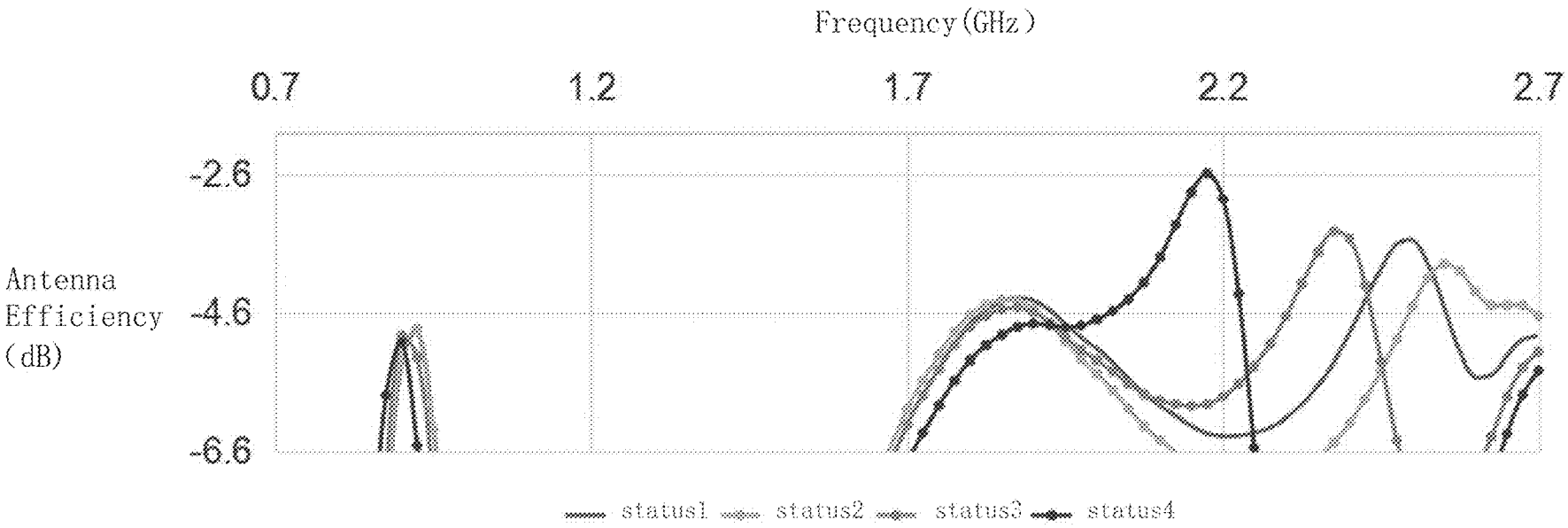
FIG. 8 illustrates simulation results of the radiation efficiency of a comparation first antenna module.

FIG. 8 shows the radiation efficiency curve of a comparation first antenna module. The comparation first antenna module is similar to the first antenna module as shown in FIG. 7. The difference is, the second tuning circuit 70 of the comparation first antenna module is not implemented with a capacitor connected in series. It can be seen from the curve that significant deviation and degradation of the low frequency harmonic of the comparation first antenna module occurs when the medium and high harmonics switch.

Compared with related art, the first antenna module of the present invention may generate LTE medium and high frequency harmonics and achieve carrier aggregation of low, medium and high frequencies through a single antenna. The four operations modes may correspondingly enhance the performance in low, medium and high frequencies. The antenna system including the first antenna module of the present invention may be utilized as a MIMO antenna system.

It should be noted that, the above are merely embodiments of the present invention, and further modifications can be made for those skilled in the art without departing from the inventive concept of the present invention. However, all these modifications shall fall into the protection scope of the present invention.

What is claimed is:

1. An antenna system for a mobile terminal, the mobile terminal comprising a metal frame and a system grounding spaced apart from the metal frame, wherein the antenna system comprises at least a first antenna module, a second antenna module, a third antenna module and a fourth antenna module;

the first antenna module comprises a radiating body formed in the metal frame and a parasitic element coupled to the radiating body, the radiating body is configured to generate a main harmonic, and the parasitic element is configured to generate a parasitic harmonic;

the first antenna module further comprises a first tuning circuit and a second tuning circuit, the first tuning circuit is connected in series between the radiating body and the system grounding, the second tuning circuit is connected in series between the parasitic element and the system grounding;

the antenna system is characterized in that, the antenna system comprises at least four operation modes, wherein in a first operation mode, the first tuning circuit of the first antenna module switches among multiple operation states such that the main harmonic covers an LTE low frequency and switches among multiple wave bands of the LTE low frequency, the second tuning circuit is configured to keep one operation state such that the parasitic harmonic covers an LTE medium frequency and an LTE high frequency, the second tuning circuit comprises at least one small-capacitance capacitor, a capacitance of the small-capacitance capacitor is less than 0.8 pF, the first antenna module and the second antenna module cooperatively consist a 2*2MIMO system covering the LTE low, medium and high frequencies in this mode;

in a second operation mode, the first tuning circuit of the first antenna module switches among multiple operation states such that the main harmonic covers the LTE low frequency and switches among multiple wave bands of the LTE low frequency, the second tuning circuit switches among multiple operation states such that the parasitic harmonic covers the LTE medium frequency and switches among multiple wave bands of the LTE medium frequency, the first antenna module, the second antenna module, the third antenna module and the fourth antenna module cooperatively consist a 4*4MIMO system covering the LTE medium frequency in this mode;

in a third operation mode, the first tuning circuit switches among multiple operation states such that the main harmonic covers the LTE low frequency and switches among multiple wave bands of the LTE low frequency, the second tuning circuit switches among multiple operation states such that the parasitic harmonic covers the LTE high frequency and switches among multiple wave bands of the LTE high frequency, the first antenna module, the second antenna module, the third antenna module and the fourth antenna module cooperatively consist a 4*4MIMO system covering the LTE high frequency in this mode;

in a fourth operation mode, the first tuning circuit is configured to keep one operation state such that the main harmonic covers the LTE medium and high frequencies, the second tuning circuit is configured to keep one operation state such that the parasitic harmonic covers the LTE medium and high frequencies, the first antenna module, the second antenna module, the third antenna module and the fourth antenna module cooperatively consist a 4*4MIMO system covering the LTE medium and high frequencies.

2. The antenna system of claim 1, further comprising a grounding line and a parasitic line, wherein the grounding line electrically connects the radiating body and the system grounding, the parasitic line electrically connects the parasitic element and the system grounding, the first tuning circuit is connected in series to the grounding line, the second tuning circuit is connected in series to the parasitic line.

3. The antenna system of claim 1, wherein in any of the first operation mode, the second operation mode and the third operation mode, the first tuning circuit is grounded through an inductor.

4. The antenna system of claim 1, wherein in the fourth operation mode, the first tuning circuit is grounded through an inductor or a capacitor, or the first tuning circuit is short-circuited to ground.

5. The antenna system of claim 1, wherein in any of the second operation mode, the third operation mode and the fourth operation mode, the second tuning circuit is grounded through a capacitor or a combination of an inductor and a capacitor.

6. The antenna system of claim 1, wherein in any operation mode of the antenna system, the third antenna module further operates in GPS and Wi-Fi frequencies, and the fourth antenna module further operates in a Wi-Fi frequency.

7. The antenna system of claim 1, wherein the mobile terminal comprises a top frame located at a top of the mobile terminal and a bottom frame located at a bottom of the mobile terminal;

the first antenna module and the fourth antenna module are arranged at two ends of the bottom frame respectively;

the second antenna module and the third antenna module are arranged at two ends of the top frame respectively; and the first antenna module and the second antenna module are arranged along a diagonal of the mobile terminal.

8. The antenna system of claim 7, wherein the first antenna module further comprises a metal connector connecting the bottom frame and the system grounding, the first antenna module defines a gap formed in the metal frame;

a portion of the metal frame between the metal connector and the gap consist the radiating body, a distance between the metal connector and an end of the radiating body away from the metal connector is no larger than ⅔ of a length of the bottom frame.

9. A mobile terminal, comprising the antenna system of claim 1.

10. The mobile terminal of claim 9, further comprising a grounding line and a parasitic line, wherein the grounding line electrically connects the radiating body and the system grounding, the parasitic line electrically connects the parasitic element and the system grounding, the first tuning circuit is connected in series to the grounding line, the second tuning circuit is connected in series to the parasitic line.

11. The mobile terminal of claim 9, wherein in any of the first operation mode, the second operation mode and the third operation mode, the first tuning circuit is grounded through an inductor.

12. The mobile terminal of claim 9, wherein in the fourth operation mode, the first tuning circuit is grounded through an inductor or a capacitor, or the first tuning circuit is short-circuited to ground.

13. The mobile terminal of claim 9, wherein in any of the second operation mode, the third operation mode and the fourth operation mode, the second tuning circuit is grounded through a capacitor or a combination of an inductor and a capacitor.

14. The mobile terminal of claim 9, wherein in any operation mode of the antenna system, the third antenna module further operates in GPS and Wi-Fi frequencies, and the fourth antenna module further operates in a Wi-Fi frequency.

15. The mobile terminal of claim 9, wherein the mobile terminal comprises a top frame located at a top of the mobile terminal and a bottom frame located at a bottom of the mobile terminal;

the first antenna module and the fourth antenna module are arranged at two ends of the bottom frame respectively;

the second antenna module and the third antenna module are arranged at two ends of the top frame respectively; and the first antenna module and the second antenna module are arranged along a diagonal of the mobile terminal.

16. The mobile terminal of claim 9, wherein the first antenna module further comprises a metal connector connecting the bottom frame and the system grounding, the first antenna module defines a gap formed in the metal frame;

a portion of the metal frame between the metal connector and the gap consist the radiating body, a distance between the metal connector and an end of the radiating body away from the metal connector is no larger than ⅔ of a length of the bottom frame.

* * * * *